US006227129B1

(12) United States Patent
Parker, Jr.

(10) Patent No.: US 6,227,129 B1
(45) Date of Patent: May 8, 2001

(54) ADAPTER PLATE FOR EMBROIDERING MACHINE AND METHOD OF EMBROIDERING

(76) Inventor: Bill T. Parker, Jr., c/o Sage Graphics, 1437 W. Oaklawn, Pleasanton, TX (US) 78064

( * ) Notice: Subject to any disclaimer, the term of this patent is extended or adjusted under 35 U.S.C. 154(b) by 0 days.

(21) Appl. No.: 09/395,330

(22) Filed: Sep. 13, 1999

(51) Int. Cl.[7] ..... D05C 9/04
(52) U.S. Cl. ..... 112/475.18; 112/103; 112/470.14
(58) Field of Search ..... 112/475.18, 470.14, 112/470.06, 475.11, 103, 102.5, 63, 470.18; 38/102.2

(56) References Cited

U.S. PATENT DOCUMENTS 5,291,843 * 3/1994 Hori ..... 112/103
5,649,496 * 7/1997 Morita ..... 112/103
5,842,430 * 12/1998 Mack ..... 112/103
5,937,774 * 8/1999 Hayashi ..... 112/103
6,065,413 * 5/2000 Kawaguchi ..... 112/470.14

* cited by examiner

*Primary Examiner*—Peter Nerbun
(74) *Attorney, Agent, or Firm*—Mark R. Wisner

(57) ABSTRACT

An adapter plate for a computer-controlled embroidering machine which allows the use of the embroidering machine for both embroidering flat and tubular goods and caps without removing the cap driver. The adapter plate is attached to the X-axis drive system of the embroidering machine and includes a base plate which is provided with a cloth spreading frame for holding a workpiece. The cloth spreading frame is mounted to the base plate in a position which holds the workpiece over a cut out formed in one edge of the base plate, the cut out allowing access to a workpiece which is secured to the cap driver when the cloth spreading frame is not being used to hold a flat or tubular workpiece.

15 Claims, 5 Drawing Sheets

ADAPTER PLATE FOR EMBROIDERING MACHINE AND METHOD OF EMBROIDERING

FIELD OF THE INVENTION

The subject invention relates to an adapter plate for an embroidering machine, particularly, a computer-controlled embroidering machine, which allows the machine to be used for embroidering tubular and flat goods, as well as caps, without removing the a cap driver from the machine. More specifically, the subject invention relates to an adapter plate which is detachably mounted to the drive system which comprises a portion of the embroidering machine as provided by the manufacturer and which need not be removed from the drive system during embroidery of both tubular and flat goods using the positioning plate provided on the adapter plate as well as caps using the cap driver which is mounted to the machine in conventional fashion.

BACKGROUND OF THE INVENTION

Computer-controlled embroidering machines are made by a number of manufacturers and marketed under several brandnames. All such machines are generally comprised of a sewing head, a clamp, frame, hoop, or sash for stretching and securing a workpiece under the sewing head, and a drive system for moving the workpiece in the X and Y axes. Such machines are provided with different systems for securing the workpiece and positioning the workpiece under the sewing head. Two commonly-used systems for securing the workpiece are those which secure flat or tubular goods (the phrase "tubular goods" is often used to refer to T-shirts, sweaters and sweatshirts, jackets, and similar articles of clothing) under the sewing head and those which secure caps and hats under the sewing head, the latter often being referred to as cap drivers.

Flat and/or tubular goods are clamped or otherwise secured under the sewing head in a manner which stretches the material comprising the workpiece tightly under the sewing head for movement along the X and Y axes of the embroidering machine under the control of a computer which has been pre-programmed with the necessary instructions for producing a desired embroidery pattern on the workpiece. Various cloth spreading frames for securing flat and tubular goods under the sewing head are disclosed in, for instance, U.S. Pat. Nos. 4,834,006, 5,249,537, 5,291,843, and 5,884,571. A cap driver accomplishes the same function of securing, stretching the material, and positioning under the sewing head but is used with hats, caps, and similar articles. Cap drivers are disclosed in more detail in, for instance, U.S. Pat. Nos. 5,167,194 and 5,598,797.

Certain embroidering machines allow the user to switch from a cloth spreading frame to a cap driver so that the same machine can be used for embroidering both caps and flat/tubular workpieces. The ability to switch from one type of workpiece to the other allows the use of such a machine to embroider nearly every type of workpiece likely to be encountered in the normal use of the machine. One such machine is available under the brandname TAJIMA™.

Although the ability to switch from the spreading frame used for flat and tubular goods to the cap driver increases the utility of the machine, so far as is known, the construction of such machines is such that the frame used for flat and tubular goods must be removed from the machine to operate the machine with the cap driver on the X-Y drive system. The frame used for flat and tubular goods must therefore be removed from the X-Y drive system when the cap driver is mounted to the X-Y drive system (and likewise, the cap driver must be removed to use the frame for tubular and flat goods) because the two devices physically interfere with each other.

It is not always convenient to replace the frame for flat and tubular goods with the cap driver (or vice-versa) and the machine must be out of service during the switch. In many shops, the operator may not be able to determine the order in which workpieces are to be embroidered such that the operator may be required to switch back and forth between cap driver and the frame for flat and tubular goods several times over a relatively short time.

Embroidering machine manufacturers have provided a variety of designs for shortening the time required for this switch. For instance, the frame for flat and tubular goods which is provided with the above-mentioned TAJIMA™ machine can be detached from the carriage of the X-Y drive system by removing two pairs of screws from a so-called joint plate which comprises a portion of the carriage of the drive system. Attaching the cap driver to the drive system is equally simple. However, even these operations take time, and in a busy embroidery shop, every minute the machine is out of service is a minute in which the machine is not turning out product, and when the cap driver and the frame for flat and tubular goods must be switched back and forth multiple times each day, for instance, productivity suffers.

The patent literature discloses a number of hoops and spreading frames for holding a workpiece under a sewing head, some of which are listed above. At least one patent, U.S. Pat. No. 4,831,753, appears to disclose a different approach to this problem of time that is lost during the switch by providing an embroidery frame which can be used to clamp a hat so that no cap driver is necessary. However, so far as is known, the device disclosed in that patent is not in common use. The industry therefore needs a better solution to the problem of time lost during the switching of a cloth spreading frame for a cap driver, and vice versa.

It is, therefore, a primary object of the present invention to provide a solution to this loss of production caused by the time required to switch between a frame for flat and tubular goods and a cap driver.

It is a further object of the present invention to provide an adapter plate for the X-Y drive system of an embroidering machine which is used for mounting a cloth spreading frame for positioning and securing flat and tubular goods under the sewing head of the embroidering machine which also allows operation of the machine with a cap driver mounted to the X-Y drive system.

It is another object of the present invention to provide a method of embroidering a cap with such a machine with the spreading frame for use with tubular and flat goods (mounted on the adapter plate) in place under the sewing head of the machine, e.g., without removing the adapter plate from the machine.

Other objects, and the advantages, of the present invention will be apparent to those skilled in the art from the following description of the preferred embodiments of the invention.

SUMMARY OF THE INVENTION

These objects are achieved by providing an adapter plate for a machine for embroidering a workpiece, the embroidering machine comprising a drive system for moving a carriage to which a workpiece is mounted along an X axis and a Y axis for embroidering thereon, comprising a base plate, a mount integral with the base plate for attaching the base plate to the carriage of the embroidering machine, a cloth spreading frame mounted to the base plate for holding a workpiece thereto, and a cut out in said base plate, the workpiece being held over the cut out by the cloth spreading frame. In a particularly preferred embodiment, the base plate comprises front and back edges, the mount for attaching the base plate to the carriage of the embroidering machine being located near the back edge of the base plate and the cut-out being formed in the front edge of the adapter plate. In this preferred embodiment, the cloth spreading frame is mounted adjacent the front edge.

In another aspect, the present invention comprises a method of embroidering a workpiece with an embroidering machine comprising an X-axis drive system having a cap driver mounted thereto without removing the cloth spreading frame for tubular and flat goods therefrom comprising the steps of attaching an adapter plate to the embroidering machine with the cap driver mounted thereto, securing a workpiece to the cloth spreading frame, and embroidering the workpiece on the cloth spreading frame without contact between the cap driver and the adapter plate.

DETAILED DESCRIPTION OF THE PREFERRED EMBODIMENT

Figure 1:
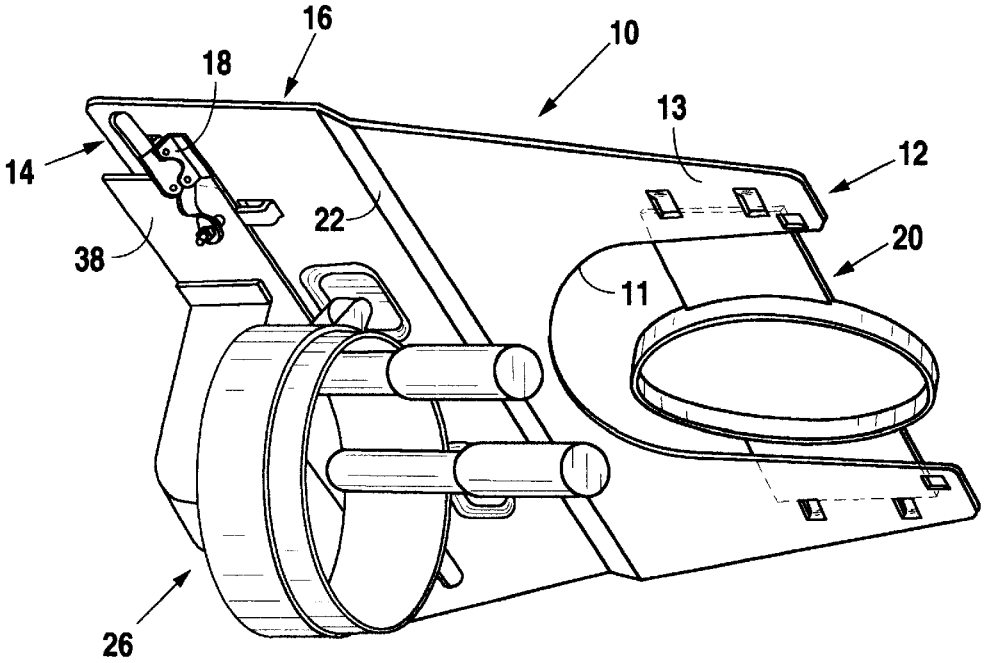
FIG. 1 is a perspective view of the underside of a preferred embodiment of an adapter plate constructed in accordance with the teachings of the present invention.

At reference numeral 10, FIG. 1 illustrates a presently preferred embodiment of an adapter plate constructed in accordance with the teachings of the present invention. In the embodiment shown in FIG. 1, adapter plate 10 is formed generally in the shape of a trapezoid with front and back edges 12 and 14, respectively, and sides 16. The adapter plate 10 is provided with a mount, in the form of the integral clamps 18, adjacent the back edge 14 thereof for attaching the adapter plate to the X-Y drive system of a commercially available embroidering machine as described below. The front edge 12 of adapter plate 10 is provided with a cloth spreading frame 20 for securing a workpiece (not shown) to adapter plate 10 and stretching the cloth of the workpiece tight for embroidering thereon in a manner known in the art.

In the preferred embodiment shown in FIG. 1, the front edge 12 of adapter plate 10 comprises two forward extensions, or arms, 13 defining the margins of a cut out 11. The cloth spreading frame 20 is comprised of two spring-loaded presser plates 21 (best shown in FIG. 4), each presser plate being mounted to a respective arm 13. The fabric of the workpiece is stretched between the two arms 13 of adapter plate 10 and secured to the adapter plate by the presser plates 21 with the portion of the workpiece to be embroidered stretched between arms 13 over the cut out 11 for embroidering. Similarly, the cut out 11 provides unimpeded access of the sewing head of the embroidering machine (not shown) to a cap (also not shown) secured to cap driver 26 for embroidering the cap with embroidering machine 24 in accordance with the method of the present invention as set out in more detail below. In an alternative embodiment, a hoop for stretching the fabric of the workpiece is held to adapter plate either by presser plates 21 or by removing presser plates 21 from adapter plate 10 and securing the hoop with a bolt (not shown) extending through a hole in the adapter plate for that purpose.

Figure 4:
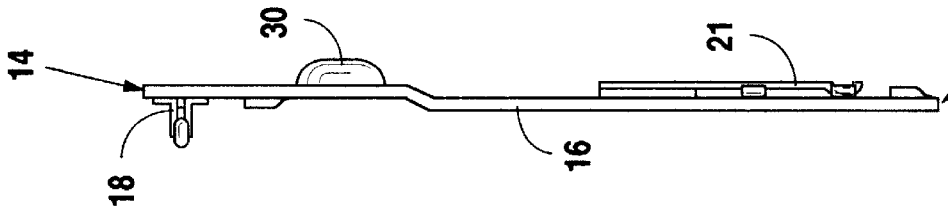
FIG. 4 is a side view of the adapter plate of FIG. 3.

Although those skilled in the art will recognize that it may not be required for use of the adapter plate 10 of the present invention with all types of embroidering machines (depending upon the clearance between the top of a cap driver when mounted to the X-Y drive system of the embroidering machine and the bottom of adapter plate 10), because the embodiment of the adapter plate 10 shown in FIG. 1 is intended for use on the above-described TAJIMA™ embroidering machine, adapter plate 10 is provided with a bend 22 running substantially parallel to the front and back edges 12 and 14. Bend 22 is best shown in FIGS. 1 and 4 and allows attachment of adapter plate 10 to the X-Y drive system of the TAJIMA™ embroidering machine at a height which provides sufficient clearance above the cap driver 26 (which is likewise mounted to the X-Y drive system) while effectively lowering the cloth spreading frame 20 to the height which is required for the sewing head of the embroidering machine. In the case of the preferred embodiment shown in FIG. 1, however, even bend 22 does not provide sufficient clearance between cap driver 26 and adapter plate 10 such that the portion of adapter plate 10 between the back edge 14 and bend 22 is provided with elongate dimples 30 (best shown in FIGS. 2 and 3) which provide sufficient clearance through which the clamps 32 used to secure the workpiece (not shown) to the cap driver 26 rotate as the X-Y drive system of the embroidering machine moves the adapter plate 10 (or the cap driver 26) along the X axis (referring to FIG. 2, the "X" axis is in and out of the plane of the paper).

Figure 2:
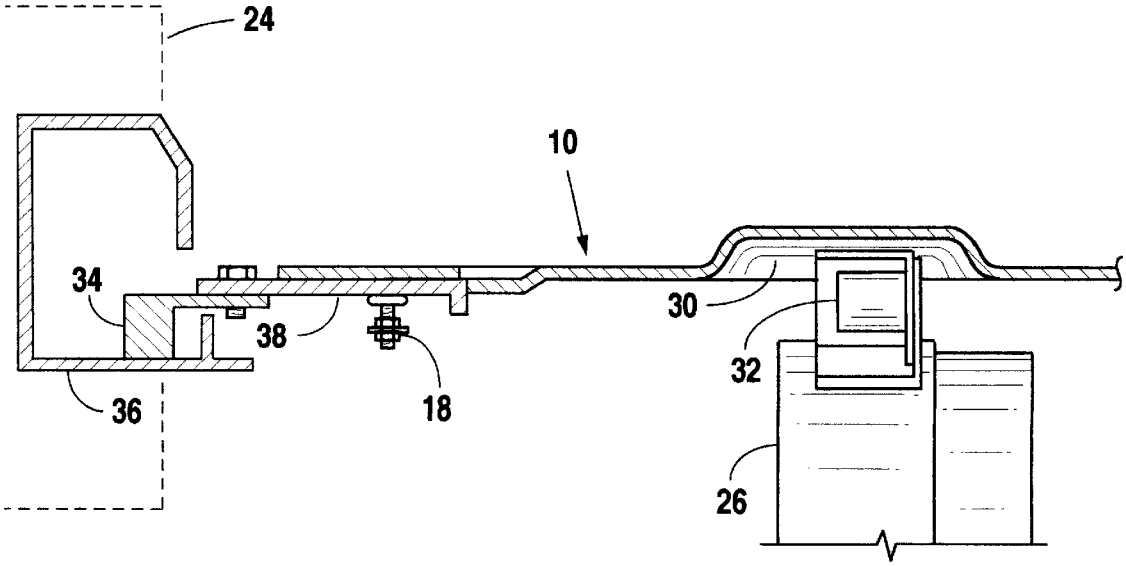
FIG. 2 is a side view of the adapter plate of FIG. 1 attached to the X-axis drive of the X-Y drive system of a commercially available embroidering machine.
Figure 3:
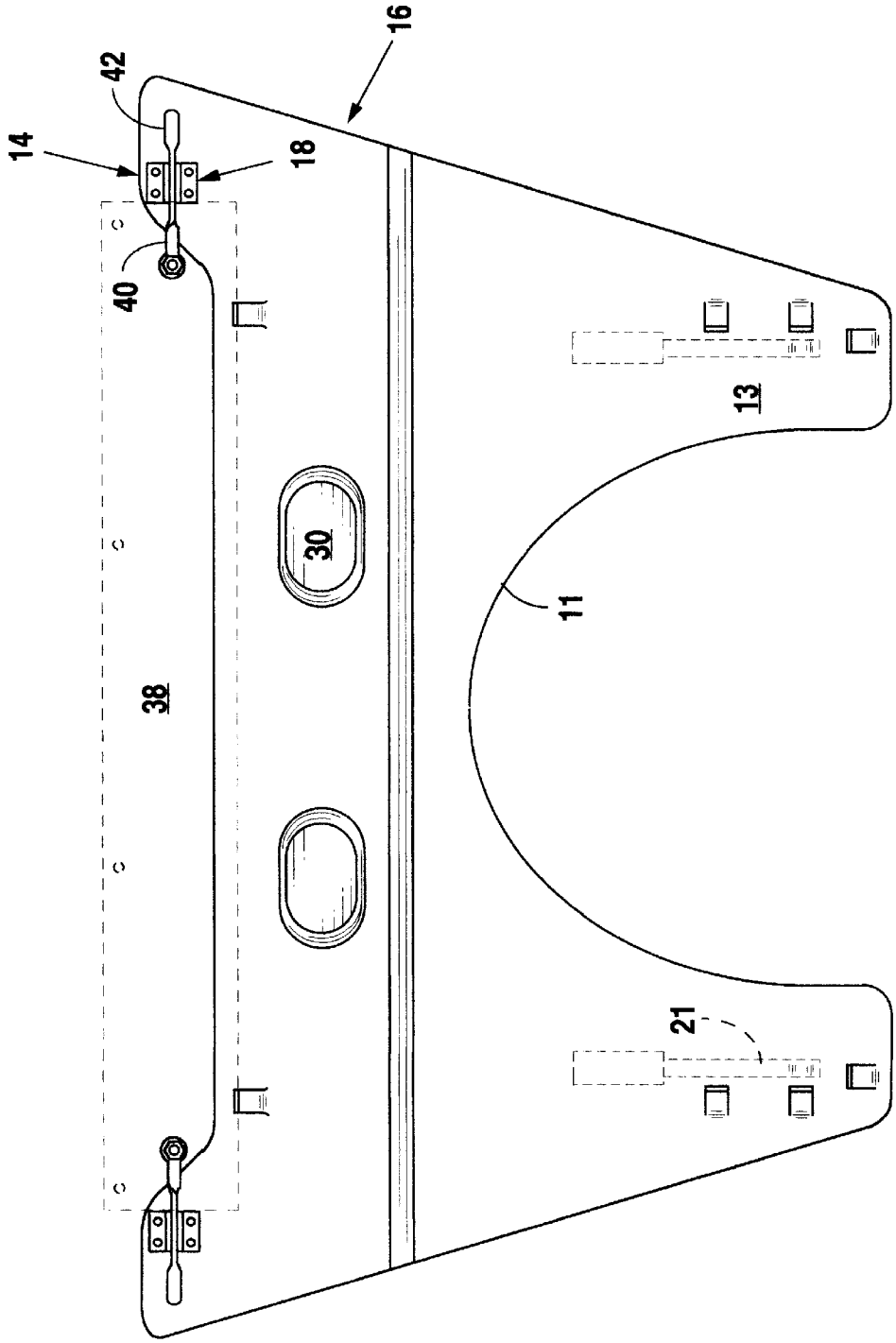
FIG. 3 is a bottom, plan view of the adapter plate of FIG. 1 showing the attachment to the X-Y drive system of a commercially available embroidering machine in shadow lines.

Referring to FIGS. 2 and 3, the mounting of adapter plate 10 to the X-Y drive system of the embroidering machine is shown in enlarged detail. In the case of the above-described TAJIMA™ embroidering machine, the X-Y drive system is provided with a carriage 34 which runs along the X axis of embroidering machine 24 by operation of a motor and gears (not shown) under control of a computer (also not shown). The X-axis of the TAJIMA™ embroidering machine 24 is defined by an X-axis traverse linear way 36 (in the view shown in FIG. 2, the frame cover of the linear way 36 has been removed and is not shown to better illustrate the attachment of the adapter plate 10) in which a joint plate 38 travels back and forth under control of the above-described computer, motor and gears. The undersurface of the joint plate 38 is engaged by the leg 40 (see FIG. 3) of clamps 18 and, when the lever 42 of clamp 18 is flipped "over center," the adapter plate 10 is attached to the joint plate 38 and travels along the X-axis defined by linear way 36 with joint plate 38.

Referring now to the drawings, a preferred embodiment of a method of embroidering a cap with an embroidering machine having a cap driver mounted to the X-axis drive system thereof will now be described. In the preferred embodiment, the method comprises the steps of attaching the adapter plate 10 to the X-axis drive system of the embroidering machine having a cap driver likewise attached thereto. In particular, adapter plate 10 is attached to the joint plate 38 which travels in the above-described X-axis traverse linear way 36 of the TAJIMA™ embroidering machine with the cap driver 26 likewise mounted thereto. With the adapter plate 10 attached to the X-axis drive system of the embroidering machine, the workpiece (not shown) is secured to cap driver 26 in the manner required by the configuration of the cap driver. The embroidering machine is then operated to drive the joint plate 38, having the adapter plate 10 attached thereto, and cap driver 26 back and forth on the X-axis (as defined by linear way 36). Movement of cap driver 26 along the X-axis manifests itself as rotation of the cap driver 26 and the third step of the method of the present invention involves rotating the cap driver 26 as adapter plate 10 moves along the linear way 36 to embroider the cap without contact between adapter plate 10 and either the cap or the cap driver 26. In this manner, the workpiece secured to cap driver 26 is embroidered while adapter plate 10 remains attached to the X-axis drive system of the embroidering machine. As noted above, adapter plate 10 is provided with the dimples 30 and, as cap driver 26 rotates and adapter plate 10 moves along the linear way 36, the clamps 32 of the cap driver 26 rotate through the dimples 30, thereby avoiding contact with adapter plate 10.

Figure 5:
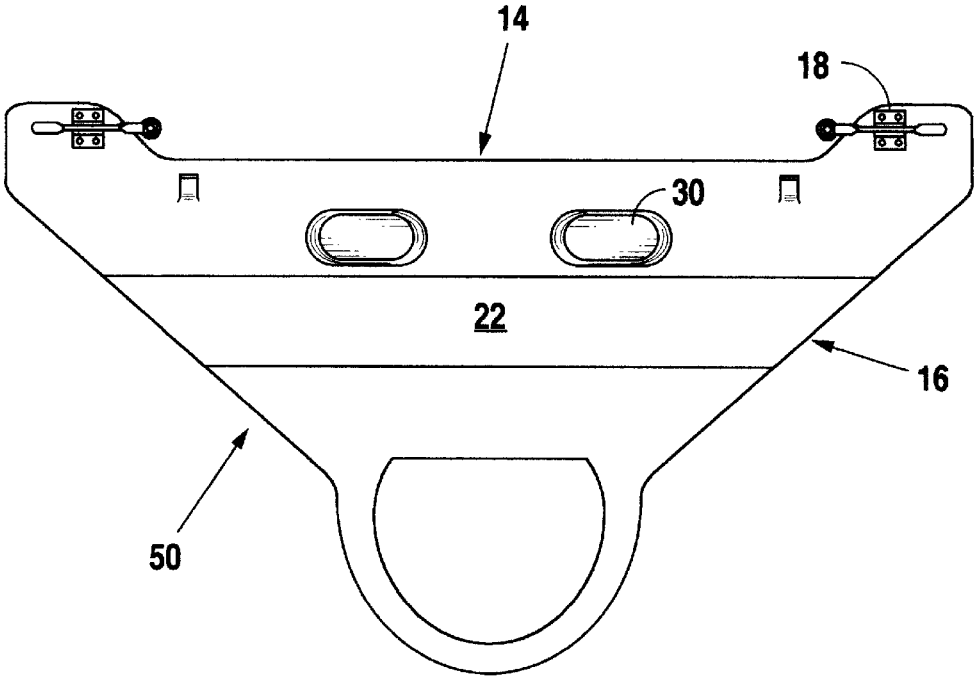
FIG. 5 is a bottom, plan view of a second preferred embodiment of the adapter plate of the present invention.
Figure 6:
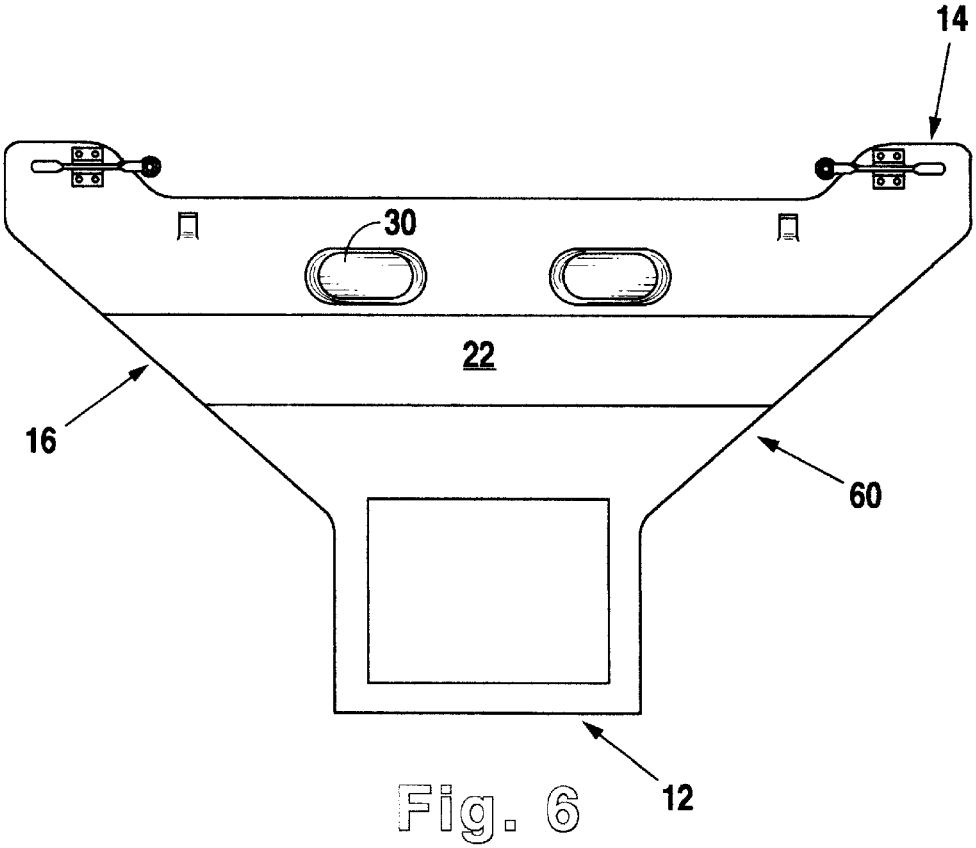
FIG. 6 is a bottom, plan view of a third preferred embodiment of the adapter plate of the present invention.

Referring now to FIGS. 5 and 6, alternate embodiments of the adapter plate of the present invention are shown, each intended for use with different workpieces. As will be recognized by those skilled in the art, the embodiment shown at reference numeral 50 in FIG. 5 is intended for use when the workpiece is the back of a cap. Similarly, the embodiment shown at reference numeral 60 in FIG. 6 is intended for use with other "hard-to-embroider" workpieces. In each of these embodiments shown in FIGS. 5 and 6, the component parts are numbered with like reference numerals as in the embodiment shown in FIGS. 1–4.

Figure 7:
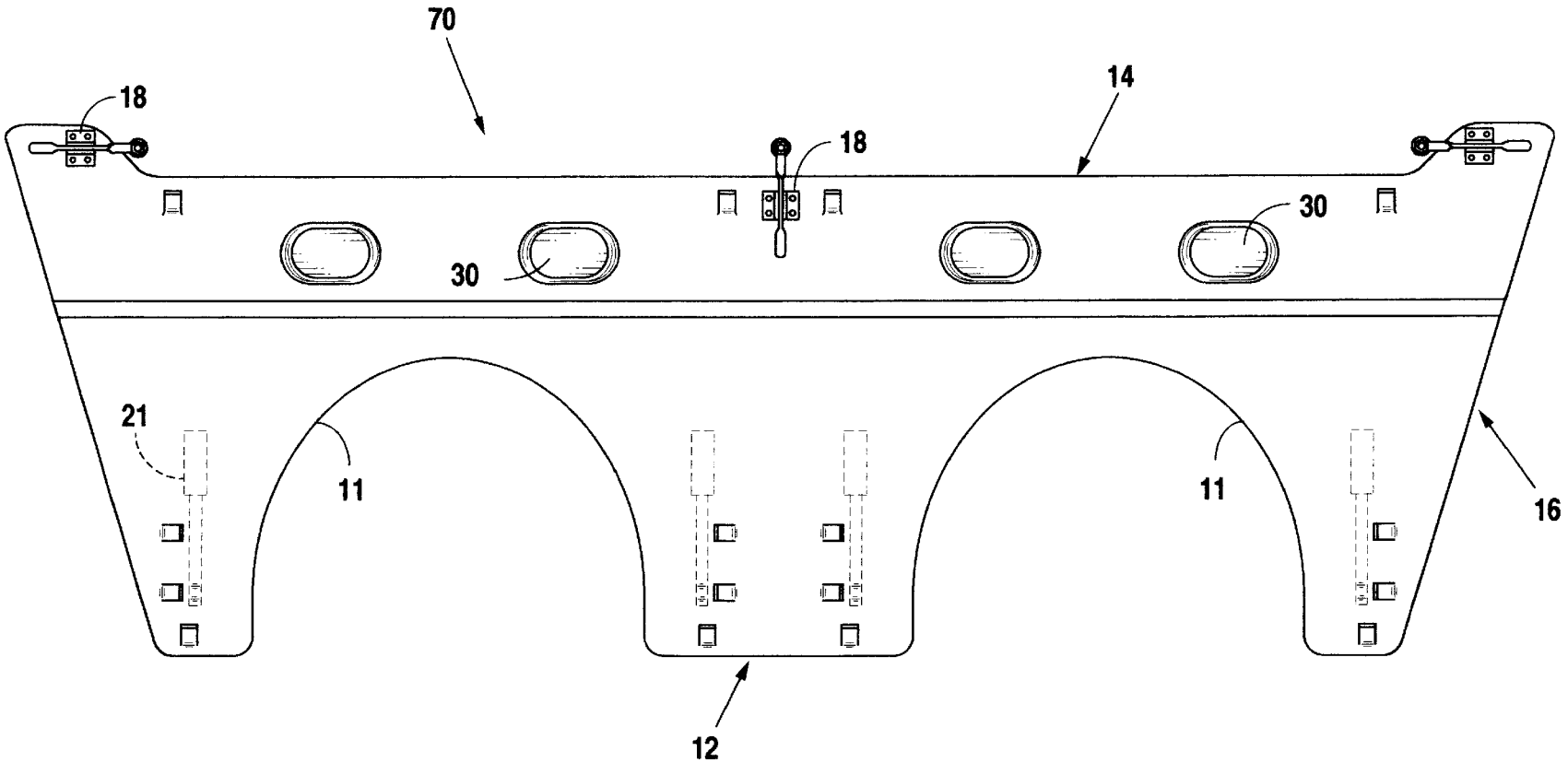
FIG. 7 is a bottom, plan view of a fourth preferred embodiment of the adapter plate of the present invention intended for use with a two head embroidering machine.
Figure 8:
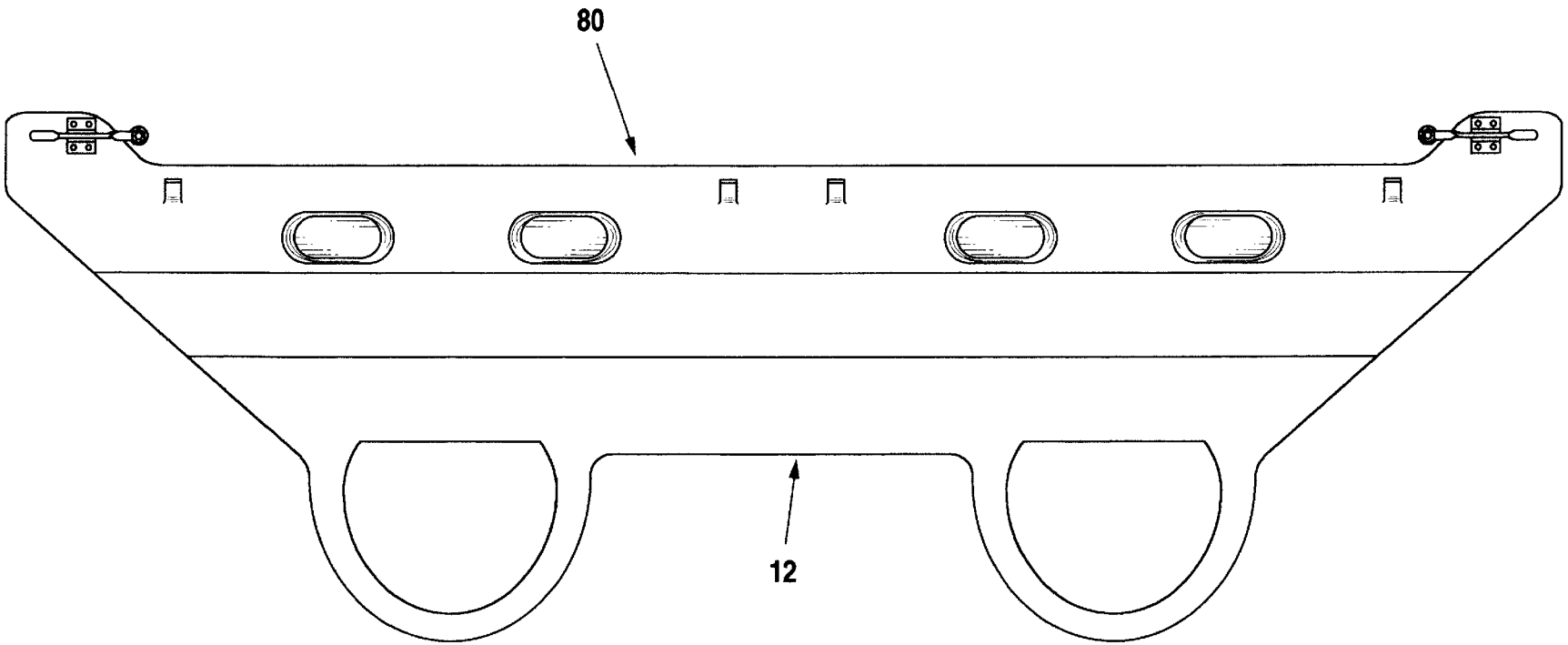
FIG. 8 is a bottom, plan view of a fifth preferred embodiment of the adapter plate of the present invention intended for use with a two head embroidering machine.

Similarly, FIGS. 7 and 8 show alternate embodiments of the adapter plate of the present invention intended for use with two-headed embroidery machines. Those skilled in the art will recognize the embodiment shown at reference numeral 70 in FIG. 7 as being similar to the embodiment shown in FIGS. 1–4 except that it is provided with two cut-outs 11 and two sets of presser plates 21 for securing the workpiece. The embodiment shown at reference numeral 80 in FIG. 8 is similar to the embodiment shown in FIG. 5 but is likewise intended for embroidering two caps at the same time.

Having described the preferred embodiments of the apparatus and method of the present invention, those skilled in the art will recognize from this description that certain changes can be made in the component parts and/or steps thereof without changing the manner in which those component parts/steps function to achieve their intended result. Some such changes, such as the omission of the bend 22 in adapter plate 10 depending upon the dimension between the cap driver and the underside of the adapter plate when the adapter plate is attached to the X-axis drive system of the embroidering machine, have been described above. Other such changes could involve, for instance, the use of a mount other than the clamps 18 to secure the adapter plate 10 to the X-axis of the embroidering machine. Indeed, those skilled in the art will recognize that the X-axis drive system of embroidering machines other than the TAJIMA™ embroidering machine described herein will have different constructions such that it may not be possible to clamp the adapter plate 10 to the X-axis drive system or to a joint plate or similar structure. Because it may not be possible to clamp or even to attach the adapter plate to a joint plate, the clamps 18 of adapter plate 10 are also described herein generically as a "mount." All that is contemplated by the use of that generic designation is that the adapter plate of the present invention be provided with some structure which enables the attachment of the adapter plate to the X-axis of the embroidering machine. Those skilled in the art will recognize from this description that such structure could take the form of, for instance, nuts and bolts, studs and cotter pins, or other structure which will function in this manner to achieve the intended result of securing the adapter plate to the X-axis drive system. All such changes are intended to fall within the spirit and scope of the following claims.

What is claimed is:

1. An adapter plate for a machine for embroidering a workpiece, said embroidering machine comprising a drive system for moving a carriage to which the workpiece is mounted along an axis for embroidering thereon, comprising:

a base plate;

a mount integral with said base plate for attaching said base plate to the carriage of the embroidering machine;

a cloth spreading frame mounted to said base plate for holding a workpiece thereto;

a cut out in said base plate, the workpiece being held over the cut out by said cloth spreading frame; and a bend formed in said base plate between said mount and said cut out for lowering said cloth spreading frame relative to said mount.

2. The adapter plate of claim 1 wherein said mount comprises a clamp.

3. The adapter plate of claim 1 wherein said base plate is provided with two arms extending from said base plate in a direction opposite the carriage of said embroidering machine and defining the margin of said cut out.

4. The adapter plate of claim 3 wherein said cloth spreading frame comprises first and second spring-loaded presser plates mounted to each of said arms.

5. An adapter plate for a machine for embroidering a workpiece, said embroidering machine comprising a drive system for moving a carriage to which the workpiece is mounted along an axis, comprising:

a base plate having front and back edges;

a mount integral with said base plate adjacent the back edge thereof for attaching said base plate to the carriage of the drive system;

a cloth spreading frame mounted to said base plate adjacent the front edge thereof for holding the workpiece thereto;

a cut out in the front edge of said base plate, the workpiece being held over the cut out by said cloth spreading frame; and a bend between the front and back edges of said base plate.

6. The adapter plate of claim 5 wherein the margin of said cut-cut is formed by first and second arms extending from the front edge of said base plate.

7. The adapter plate of claim 6 wherein said cloth spreading frame is mounted to said base plate on the arms thereof.

8. The adapter plate of claim 5 wherein said mount comprises a clamp.

9. A method of embroidering a workpiece with an embroidering machine comprising an X-axis drive system having a cap driver mounted thereto comprising the steps of:

attaching an adapter plate to the X-axis drive system of an embroidering machine having a cap driver mounted thereto;

securing a workpiece to the adapter plate; and operating the embroidering machine to embroider the workpiece with the adapter plate in place on the embroidering machine without contact between the adapter plate and the cap driver.

10. The method of claim 9 wherein the adapter plate is attached to the X-axis drive system of the embroidering machine by clamping to a carriage plate comprising a portion of the X-axis drive system.

11. The adapter plate of claim 1 additionally comprising at least one dimple formed in said base plate for providing clearance for rotation of the clamps of a cap driver mounted to said embroidering machine.

12. The adapter plate of claim 5 additionally comprising at least one dimple formed in said base plate for providing clearance for rotation of the clamps of a cap driver mounted to said embroidering machine.

13. The adapter plate of claim 5 wherein the bend in said base plate is substantially parallel to the back edge of said base plate.

14. An adapter plate for a machine for embroidering a workpiece, said embroidering machine comprising a drive system for moving a carriage to which the workpiece is mounted along an axis for embroidering thereon, comprising:

a base plate;

a mount integral with said base plate for attaching said base plate to the carriage of the embroidering machine;

a cloth spreading frame comprising first and second spring-loaded presser plates mounted to said base plate for holding a workpiece thereto; and a cut out in said base plate, the margin of said cut out being defined by two arms extending from said base plate in a direction opposite the carriage of the embroidering machine and having the presser plates of said cloth spreading frame mounted thereto, the workpiece being held over the cut out by said cloth spreading frame.

15. The adapter plate of claim 14 additionally comprising at least one dimple formed in said base plate for providing clearance for rotation of the clamps of a cap driver mounted to said embroidering machine.

* * * * *